US010086988B2

(12) United States Patent
Grobman

(10) Patent No.: US 10,086,988 B2
(45) Date of Patent: Oct. 2, 2018

(54) CONFIGURABLE PACKET FOR CONTROLLABLE MIXING AND DISPENSING OF CONDIMENTS

(71) Applicant: Katie Rose Grobman, New York, NY (US)

(72) Inventor: Katie Rose Grobman, New York, NY (US)

( * ) Notice: Subject to any disclaimer, the term of this patent is extended or adjusted under 35 U.S.C. 154(b) by 0 days.

(21) Appl. No.: 15/094,513

(22) Filed: Apr. 8, 2016

(65) Prior Publication Data

US 2017/0291752 A1 Oct. 12, 2017

(51) Int. Cl.

| | |
|---|---|
| ***B65D 81/32*** | (2006.01) |
| ***B65D 75/58*** | (2006.01) |
| ***B65D 75/30*** | (2006.01) |
| ***B65D 77/08*** | (2006.01) |
| ***B65B 1/02*** | (2006.01) |
| ***B65B 1/04*** | (2006.01) |
| ***B65B 61/18*** | (2006.01) |

(52) U.S. Cl.

CPC ..... *B65D 81/3266* (2013.01); *B65B 1/02* (2013.01); *B65B 1/04* (2013.01); *B65B 61/18* (2013.01); *B65D 75/30* (2013.01); *B65D 75/5811* (2013.01); *B65D 77/08* (2013.01); *B65D 81/3261* (2013.01)

(58) Field of Classification Search

CPC ..... B65D 75/367; B65D 75/368; B65D 75/5811; B65D 75/30; B65D 75/585; B65D 81/3294; B65D 81/3266; B65D 81/3261; B65D 81/3272; B65B 1/02; B65B 1/04

USPC ..... 222/541.6, 145.5, 145.6, 92–107; 206/219, 469, 484

See application file for complete search history.

(56) References Cited

U.S. PATENT DOCUMENTS

| | | | | |
|---|---|---|---|---|
| 2,635,788 A | | 4/1953 | Snyder et al. | |
| 3,156,352 A | * | 11/1964 | Hayhurst | B65D 81/3266 206/219 |
| 3,294,227 A | * | 12/1966 | Schneider | B65D 81/3266 206/219 |
| 3,608,709 A | * | 9/1971 | Pike | B29C 65/76 206/219 |
| 4,493,574 A | * | 1/1985 | Redmond | B65D 75/368 206/469 |
| 4,790,429 A | * | 12/1988 | Fukushima | B65D 81/3266 206/219 |
| 4,952,068 A | * | 8/1990 | Flint | B01F 5/0602 206/219 |
| 4,997,083 A | * | 3/1991 | Loretti | A61J 1/2093 206/219 |

(Continued)

*Primary Examiner* — Charles P Cheyney

(74) *Attorney, Agent, or Firm* — Arrubla | Taylor, PA; Andres F. Arrubla

(57) ABSTRACT

Embodiments of the present disclosure include a configurable packet that enables separately packing two or more condiments which can be mixed according to the user's preferences before the opening of the package and dispensing. According to some aspects, the configurable package can include pre-perforated portions to facilitate or allow a user to controllably mix and/or dispense condiments. Additional aspects include the flexible but still defined package's structure which includes at least two separate internally breachable compartments for at least two separate condiments and a mixed chamber to enable the mixing of the condiments without having to open the packaging.

12 Claims, 5 Drawing Sheets

(56) References Cited

U.S. PATENT DOCUMENTS

| | | | | |
|---|---|---|---|---|
| 5,967,308 | A * | 10/1999 | Bowen | A47J 36/28 206/219 |
| 6,231,559 | B1 * | 5/2001 | Loretti | A61J 1/2093 604/410 |
| 6,868,987 | B2 * | 3/2005 | Hedington | A61J 1/10 222/102 |
| 6,968,952 | B2 * | 11/2005 | Crevier | B65D 81/3266 206/219 |
| 7,121,409 | B1 | 10/2006 | Hamilton et al. | |
| 8,083,103 | B2 * | 12/2011 | LaFlamme | B05B 11/3032 222/135 |
| 8,157,783 | B2 * | 4/2012 | Yoshikawa | A61J 1/2093 206/219 |
| 8,689,972 | B2 * | 4/2014 | Sanchez | B65D 75/5866 206/219 |
| 2004/0065679 | A1 * | 4/2004 | Peuker | B65D 81/3266 222/107 |
| 2005/0087456 | A1 * | 4/2005 | Oka | A61J 1/2093 206/219 |
| 2006/0237477 | A1 | 10/2006 | Gregg | |
| 2007/0246379 | A1 * | 10/2007 | Kuenzel | B65D 75/008 206/219 |
| 2012/0074002 | A1 * | 3/2012 | Steele | B65D 81/3266 206/219 |
| 2012/0223099 | A1 | 9/2012 | Sanchez | |
| 2012/0241466 | A1 | 9/2012 | Genosar et al. | |
| 2014/0033655 | A1 | 2/2014 | Stanley et al. | |

* cited by examiner

CONFIGURABLE PACKET FOR CONTROLLABLE MIXING AND DISPENSING OF CONDIMENTS

FIELD OF THE INVENTION

The present invention relates generally to the field of food packaging and more particularly to an improved disposable packet that enables a user to mix condiments prior to dispensing in a controlled manner.

BACKGROUND OF THE INVENTION

Widespread use of disposable food packaging has been adopted by restaurants, fast food establishments and people generally. In some cases, and in the case of the packaging of condiments, the design of the condiment packaging design option has been driven by food preservation and enabling the user to select only those condiments he/she wants to add to the particular meal or drink. As a result, traditional dry and wet condiment packets are typically limited to a single condiment. For example, ketchup packets, mayonnaise, mustard, hot sauce, salt, pepper, sweeteners, etc. Using individually packed wet/dry single condiment demands that a customer desiring to mix two condiments before adding to the food/drink to dispense in a bowl and use cutlery to mix. For instance, if a user visits a take out fast food place and wants to make a mixture of two or more condiments, e.g., russian dressing, to put on their food, he/she would get a ketchup packet and a mayonnaise packet, dispense into a container and use a fork to mix the two together.

More recently, various types of packets have been designed to improve the user's experience and reduce waste. For example, U.S. Pat. Pub. No. US 20120223099 A1 describes a container that uses a foldable hard piece of plastic to squeeze all of the packet's contents out of the package when it is folded in half; U.S. Pat. Pub. No. 20060237477 A1 similarly describes a packet with two chambers for two types of condiments to be dispensed through a common nozzle; U.S. Pat. No. 7,121,409 B1 describes a packet with a hard tray portion that breaks in half releasing substance out of the center of the packet; and U.S. Pat. Pub. No. US20140033655 describes a packet that allows for additive fluid/substance from outside of the packet to be added and mixed with a packet's content, all of which suffer from being able to mix controlled amounts of two or more separately contained condiments before dispensing, as well as adding unmixed contents of a selected unmixed condiment type from two or more condiments in a practical and improved configurable packet alternative. Accordingly;

There is a need for low cost condiment packaging that can be used for more than one type of condiment and is designed to reduce waste materials;

There is a need for condiment packaging that allows a user to mix amounts of two or more separately contained condiments prior to dispensing;

There is a need for condiment packaging that enables a user the controlled dispensing of one or both of a condiment mixture and an individual condiment;

There is a need to consolidate condiments in packaging to provide a user with mixture options that include different rations of each of the condiments according to personal preference.

Accordingly, improved practical disposable configurable packets that can be easily and relatively inexpensively manufactured and overcome the aforementioned needs are desired.

SUMMARY OF THE INVENTION

The foregoing needs are met, to a great extent, by the present invention, wherein in some aspects of embodiments of the invention are intended to address one or more of the above noted fundamental problems associated with food packaging. The improved configurable packet for controllable mixing and dispensing of condiments, for example, allowing a user to mix controlled amounts of two or more condiments contained in the packet prior to dispensing while leaving unused amounts of condiments for independent and also controlled unmixed condiment dispensing.

According to some aspects of the disclosure, a packet for controllable mixing and dispensing of condiments is disclosed. More specifically, the packet including at least a first compartment containing a first condiment type and a second compartment containing a second condiment type. The first compartment formed by a pair of supple walls bonded to each other throughout the perimeter and to a first partition section, and having a dispensing end with at least one pre-perforated slit to provide an outlet for dispensing of said first condiment. The first partition section being at least partially breachable to provide the first condiment type access to a mixing chamber. The second compartment also formed by the pair of supple walls to each other throughout the perimeter and to a second partition section. The second partition also being at least partially breachable to provide the second condiment type access to the mixing chamber. The mixing chamber formed by at least the pair of supple walls bonded to each other throughout the perimeter of the package and the first and second partitions. According to some aspects, by this the mixing chamber is configured to receive at least said first condiment and said second condiment upon the breaching of at least a portion of each of said first and second partitions without unbonding the supple walls from each other and releasing the condiments from the packet and may also be additionally configured to dispense a mixture of at least said first and second condiments through a separate dispensing section having at least one pre-perforated slit.

In some embodiments, the breaching of at least a portion of each first and second is facilitated by one or more pre-perforated slits. The pre-perforated slits may be defined by a plastic insert used to prevent the mixed condiments in the mixing chamber from being transferred back to the first or the second partitions. The assembly of the pair of supple walls may be done via heat staking, for example. According to some aspects, some embodiments may additionally include folding slits on a linear portion of one or both of the supple walls to facilitate folding of the package for the dispensing of mixed condiments. The folding slit may be such that at least a portion of one or more pre-perforated slit having a pre-determined size to allow for controlled dispensing of the mixed condiments from the mixing chamber. In some embodiments, a dispensing end on the second compartment having at least two pre-perforated slits of pre-determined sizes to allow for controlled dispensing of the second condiment may be included. According to yet additional aspects, in some embodiments plastic inserts may be included in the packet to act as control valves and/or assist in the breaching of the partitions. Other features that may enable/assist in the breaching of the partitions may include tabs or pressure/tear points instructions to the user.

According to aspects of the disclosure, aspects for corresponding methods for manufacturing the packet are also disclosed.

Other aspects of the invention will be understood by those of skill in the art upon review of the teachings herein. Other aspects of the invention may involve combinations of the above noted aspects of the invention. These other aspects of the invention may provide various combinations of the aspects presented above as well as provide other configurations, structures, functional relationships, and processes that have not been specifically set forth above.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention.

Figure 1A:
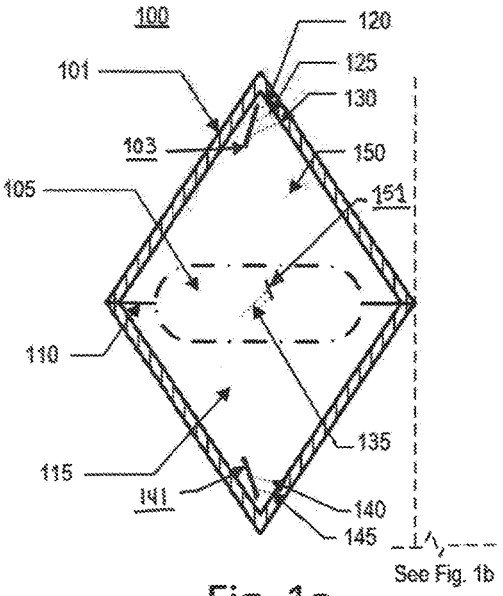
FIG. 1*a* is a top view of an exemplary configurable packet 100 according to some aspects of the disclosure.

The present invention is further described in the detailed description that follows.

DETAILED DESCRIPTION OF THE INVENTION

Going forward, various aspects of the configurable packet of the present disclosure may be illustrated by describing components that are coupled, attached, and/or joined together. As used herein, the terms "bonded", "heat staked", "coupled", "attached", and/or "joined" are used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements present.

Relative terms such as "lower" or "bottom" and "upper" or "top" may be used herein to describe one element's relationship to another element illustrated in the drawings. It will be understood that relative terms are intended to encompass different orientations of the steering device in addition to the orientation depicted in the drawings. By way of example, if aspects of the steering device shown in the drawings are turned over, elements described as being on the "bottom" side of the other elements would then be oriented on the "top" side of the other elements. The term "bottom" can therefore encompass both an orientation of "bottom" and "top" depending on the particular orientation of the apparatus.

Various aspects of the steering device may be illustrated with reference to one or more exemplary embodiments. As used herein, the term "exemplary" means "serving as an example, instance, or illustration," and should not necessarily be construed as preferred or advantageous over other embodiments of a steering arm or assembly disclosed herein.

GLOSSARY

In this description and claims directed to the disclosure, various terms may be used for which the following definitions will apply:

"Condiments", as used herein, can refer to wet/dry edible products that are individually packaged for a consumer to add to food/drink. Condiments may include those typically individually packaged in disposable packets, including for example, wet condiments such as ketchup, mayonnaise, mustard, honey, syrup, salad dressings and/or toppings, etc. and/or dry condiments such as salt, pepper, sweeteners, cinnamon, vanilla, etc.

"Controllable dispensing", as used herein, can refer to dispensing of one or a mixture of two or more condiments via an outlet having a size selected from two or more pre-configured pre-perforated sections by a user.

"Controllable mixing", as used herein, can refer to the mixing of all or variable amounts (as per user preference) of two or more condiments, while the condiments in the packet remain enclosed, in a chamber of the packet. For example, the user may move desired amounts of two or more condiments contained in separate compartments to the mixing chamber and squeeze walls of the mixing chamber and/or shake to mix the contents in the mixing chamber prior to dispensing.

"Pre-perforated", as use herein, can refer to small indentations or micro sized holes made to pre-defined portions of one or both of the supple walls of the packet made to enable a user to easily create an outlet for dispensing of a condiment or mixture thereof. In some embodiments, the pre-perforations can also refer to small indentations or micro sized holes made to pre-defined portions of partition walls of the mixing chamber made to enable the user to transfer a condiment from a compartment to the mixing chamber.

"Re-enforcement strip(s)", as used herein, can refer to one or more strips of material added near the pre-perforated sections to prevent rupture or expansion of the tear past the pre-perforated sections.

"Supple walls", as used herein, refers to non-rigid food grade paper or food grade plastic (e.g., polyethylene, polyvinylidene chloride and/or similar food packaging homopolymer of vinylidene chloride, aluminum laminated plastics, etc.) walls used to provide a flexible structural integrity of the packet and contain the condiments.

"Breach", "Tear", "break", or "open", as used herein with respect to the partition walls between a compartment portion and the mixing chamber, can refer to an action by the user to communicate the compartment portion to the mixing chamber. In some embodiments, for example, the user may breach at least a portion of the partition walls by pressing or pulling on a section of the package. In some embodiments, tabs or indications of the sections which the user should press and/or pull to accomplish the breach can be included in the exterior of the configurable packet. In yet additional embodiments, a plastic piece near or forming part of the partition walls can be included to facilitate the break.

"Valve", as used herein, can refer to a plastic insert used to control the flow of condiments from/to the mixing chamber. In some embodiments, the plastic insert can serve as a one-way valve that can be opened via manual manipulation of the user in order to allow the flow of condiments to the mixing chamber.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as one skilled in the art would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law. Moreover, it is noted that like reference numerals can represent similar parts throughout the several views of each of the embodiments in the drawings.

Referring to FIG. 1*a* a top view of an exemplary configurable packet 100 according to aspects of the disclosure is depicted. In particular, configurable packet 100 including two condiment compartments 115, 150 and a mixing chamber 105 to enable controlled mixing and controlled dispensing according to various aspects of the disclosure. Each of the condiment compartments 115, 150 can contain a type of dry or wet condiment. While the compartments 115, 150 are shown to be equally in size, in some embodiments, each compartment may be sized according to the typical amount of condiment used and thus vary in size. Permeability and the flexible nature of each compartment may also vary depending on the type of condiment.

Figure 1B:
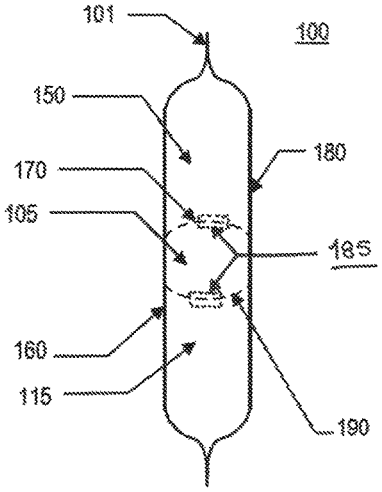
FIG. 1*b* is a side view of the exemplary configurable packet 100 of FIG. 1*a;*
Figure 1C:
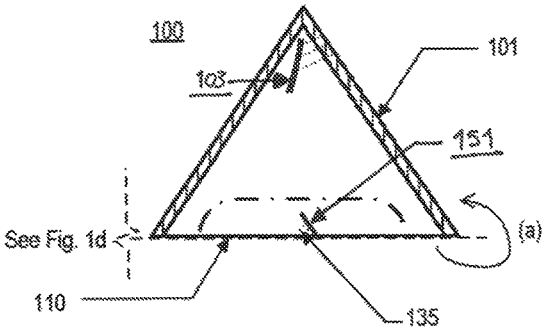
FIG. 1*c* is a top view of the exemplary configurable packet 100 shown in FIGS. 1*a* and 1*b* folded at (a) for mixing and/or dispensing.

Mixing chamber 105 is shown to be between the first compartment 150 and the second compartment 115. Prior to user manipulation, the condiments stored in both the first compartment 150 and the second compartment 115 should be kept away from the mixing chamber 105 by wall partitions 170,190 (shown in FIG. 1*b* and further described below). The volume of mixing chamber 105 can be designed to be at least the volume of the sum of the volume of the first compartment 150 and the second compartment 115. In packages that are designed to contain a wet condiment and a dry condiment that will expand when mixing with the wet condiment, the volume of the mixing chamber 105 will also be greater than that of the first compartment 150 and the second compartment 115 to account for expansion during the mixing of the two. Optional reinforcement strips 103, 141, 151, can be applied around at least some of the areas with the pre-perforations (e.g., as shown in FIGS. 1*a* and 1*c*).

Figure 1D:
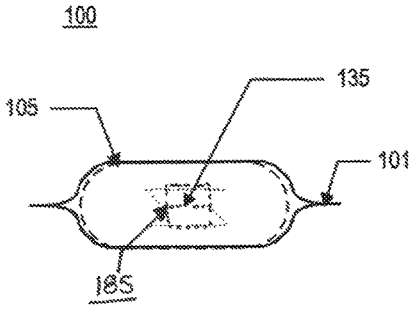
FIG. 1*d* is a side view of the exemplary configurable packet 100 shown in FIGS. 1*a*-1*c* folded as per FIG. 1*c;*

As further described below with reference to FIG. 3, the compartments 150, 115 and mixing chamber 105 may be formed by two non-rigid sheets that can be bonded along the perimeter 101 to form a supple configurable packet 100. The boundaries that are adjacent to the outside of the configurable packet 100 being the supple walls 160, 180 (shown in FIG. 1*b*). The boundaries inside the configurable packet 100 separating the compartments 115, 150, from each other and/or the mixing chamber 105 being the partitions 170, 190. As shown in FIGS. 1*b* and 1*d*, partitions 170, 190 may include a plastic insert 185. The plastic insert 185 may be configured to one or both facilitate the rupturing of a pre-perforated section and function as a valve. Both walls and partitions can generally be supple to allow the controlled mixing and/or controlled dispensing of condiments according to aspects of the disclosure. In addition, in some embodiments, folding slits 110 can be included, for example, to expose a pre-perforated section and/or controlled dispensing.

According to aspects of the disclosure, pre-perforated slits can be used to define sizes of dispensing outlets in each of the compartments and/or mixing chamber for the user to select, or to provide transfer channels from the compartments to the mixing chamber with some breaching, tearing, pulling, etc. (i.e. user manipulation). In the present exemplary configurable packet 100, for example, the first compartment 150 includes three pre-perforated slits 120, 125, 130 on a converging end. By having the three options of different pre-determined sizes, the user can select one of the pre-perforated slits 120, 125, 130 according to the desired amount of the unmixed condiment packaged therein that he/she wants to dispense and the speed in which it is dispensed. As it will be apparent to one skilled in the art, the size pre-determination of each of the pre-perforated slits will vary depending on the consistency and potency of the condiment to be contained. Similarly, pre-perforated slits 140 and 145 of the second compartment 115 can be included for selection by the user. Again, these too may depend on the condiment being contained and its properties. The number and size of the pre-perforated slits may also vary in each compartment. For example, when a condiment is hot sauce, the pre-perforated slits may be smaller in size to give the user more control over the amount dispensed.

Pre-perforated slits 135 of the mixing chamber 105 may similarly be used to allow dispensing of a mixture of the two condiments contained in the compartments 115, 150. In some embodiments, the pre-perforated slits 135 of the mixing chamber 105 may only be exposed or subject to rupture/opening after the configurable packet 100 is folded. It is to be understood that in some embodiments, more than two condiment compartments for configurable packets according to aspects of the disclosure may be included. The number and sizes of each of the compartments can vary depending on the condiments contained.

Referring now to FIG. 1*b*, a side view of the exemplary configurable packet 100 of FIG. 1*a* is depicted. In particular, this side view depicts the partition walls 170, 190 forming the mixing chamber 105 inside the configurable packed 100. By positioning the mixing chamber 105 between compartments 150, 115, controlled transfer of condiments to it may be achieved. In some embodiments which may include more than two compartments, the mixing chamber may be included at the top or bottom, so long as at least a portion of each of the compartments can lead to the mixing chamber.

Referring now to FIGS. 1*c* and 1*d*, a top view and a corresponding side view of the exemplary configurable packet 100 shown in FIGS. 1*a* and 1*b* folded at (a) for mixing and/or dispensing is depicted. In particular, so that after mixing of the condiments takes place in mixing chamber 105, dispensing of the mixture of condiments can take place via one or more pre-perforated slit 135 that may be included in a section of the mixing chamber 135. In this particular exemplary embodiment, the pre-perforated slit 135 is located across a folding slit 110. This can allow for easy selection and/or tearing of the pre-perforated slit 135 by the user after the packet is folded.

Figure 2A:
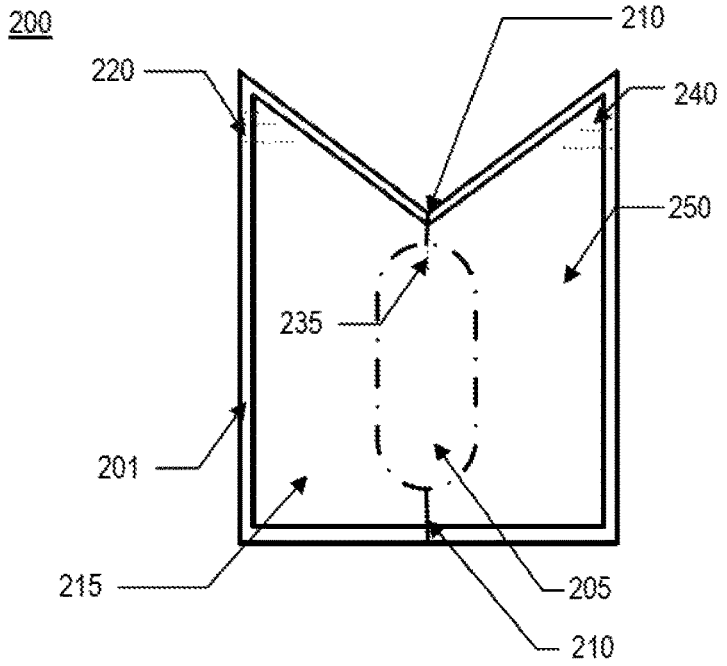
FIG. 2*a* is a top view of a second exemplary configurable packet 200 according to some aspects of the disclosure.
Figure 2B:
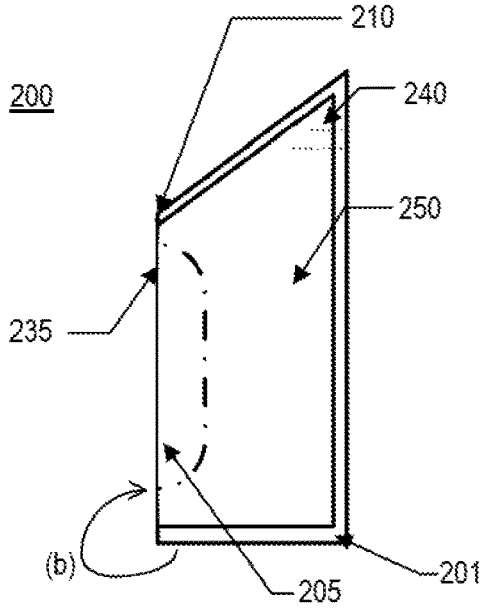
FIG. 2*b* is another top view of the second exemplary configurable packet 200 of FIG. 2*a* being folded at (B) for fixing and/or dispensing.

Referring now to FIG. 2*a*, the top view of a second exemplary configurable packet 200 according to aspects of the disclosure is depicted. In particular, configurable packet 200 has a different geometry but nevertheless can similarly be formed by supple sheets bonded along perimeter 201 and include folding slit 210, and a first compartment 215 and a second compartment 250 each with one or more corresponding pre-perforated slits 220, 240. Moreover, as it is shown in FIG. 2*b*, showing a top view of the second exemplary configurable packet 200 of FIG. 2*a* being folded at (b) for fixing and/or dispensing, the mixing chamber 205 may include a pre-perforated slit 235 at one or both distal ends of the mixing chamber 205. This may be preferred in some embodiments to prevent compromising the integrity of the mixing chamber 205 during mixing or routine handling of the configurable packet 200.

Figure 3A:
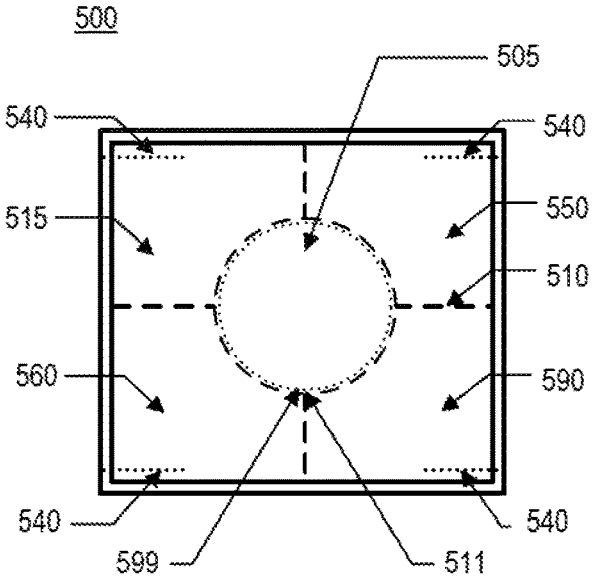
FIG. 3*a* is a top view of a third exemplary configurable packet 500 according to some aspects of the disclosure.
Figure 3B:
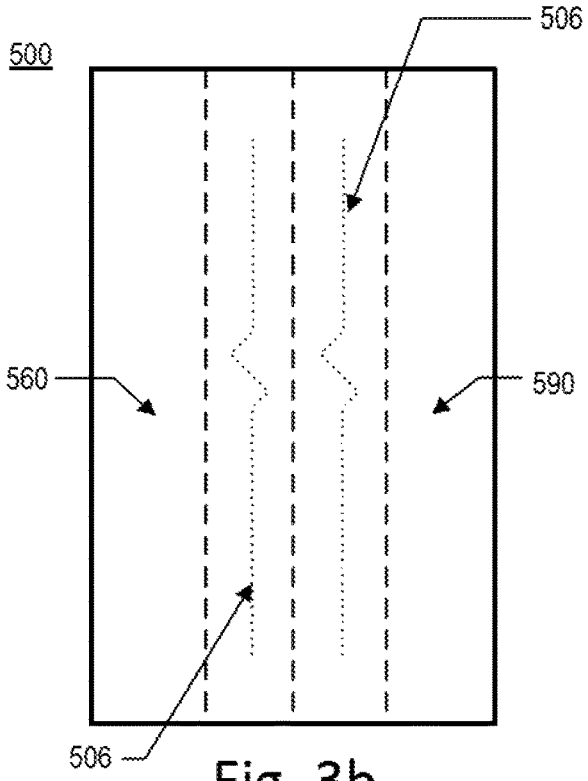
FIG. 3*b* is a front view of the third exemplary configurable packet 500 of FIG. 3*a;*

Referring now to FIGS. 3*a* and 3*b*, a top and front view of a third exemplary configurable packet 500 according to some aspects of the disclosure is shown. In particular, configurable packet having four different compartments 515, 550, 560, and 590, all at least partially connected to mixing chamber 505 located in between. As further shown, each of the four different compartments 515, 550, 560, 590 may include corresponding pre-perforated dispensing slits 540. More importantly, partition walls 510 between each of the compartments and mixing chamber 505 may include pre-perforated 506 portions that can be breached for the condiments desired to be transferred to the mixing chamber 505. As previously mentioned, these partitions may be breached by following pulling instructions of portions of the package, pulling tabs (not shown), applying pressure, or the such. The package can be configured so that each of the partitions can be breached independently of each other to enable the user to include only those condiments/food items that he/she desires to be mixed while other condiments/food items remain in their individual compartments. As shown, the mixing chamber 505, in some embodiments, the mixing chamber 505 may include a dispensing lid 599 along at an exposed surface. The dispensing lid 599 may be a peelable, for example, and be as large as the perimeter 511 on the exposed surface of the mixing chamber 505. While this disclosure refers to condiments, one skilled in the art will appreciate from the disclosure, this type of container may also be used to package varieties of yogurt, salad toppings, cereals, chips, pretzels, ice cream, and the such.

Figure 4:
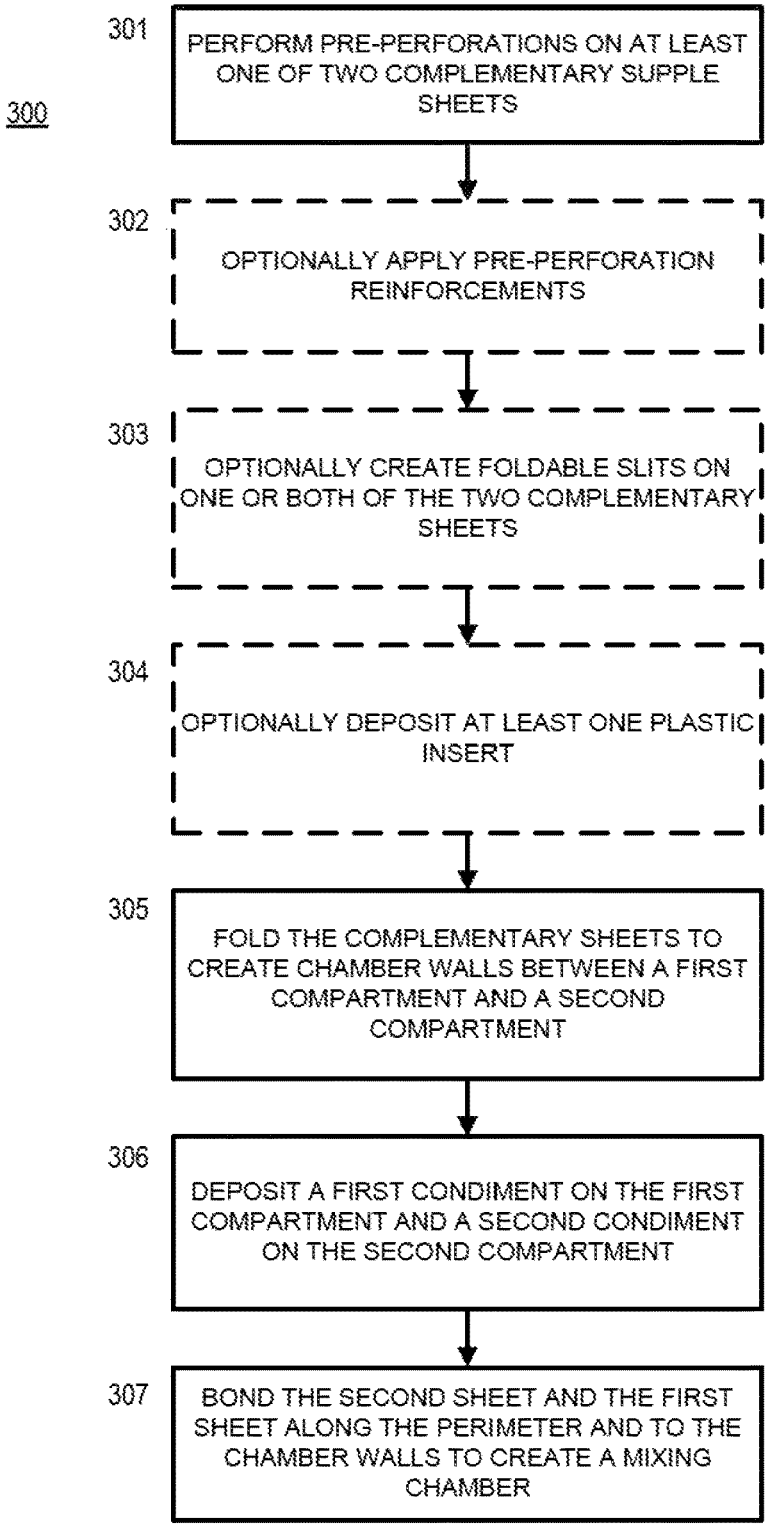
FIG. 4 is a flowchart 300 with method steps that may be used to assemble a configurable packet according to some aspects of the disclosure.

Referring now to FIG. 4, a flowchart 300 with method steps that may be used to assemble a configurable packet according to aspects of the disclosure is shown. In particular, the configurable packet enabling a user to controllably mix and dispense condiments according to aspects described in this disclosure. Beginning at step 301, pre-perforations on two complementary sheets that will act as supple walls can be performed. One skilled in the art will appreciate that the size and nature of the pre-perforations may vary depending on the condiment (as required by permeability and material composition) such that the condiment remains preserved during storage. At step 302, optional reinforcements can be applied around at least some of the areas with the pre-perforations. According to some embodiments that are meant to be folded during use, at step 303, folding slits may be made on the sheets, e.g., by pressing linearly on the sheet at the point in which the user is to fold the package during use.

For those embodiments in which a plastic insert may be used to act as a valve and/or enable the breaching of a partition, at step 304, the plastic insert may be positioned and bonded to one of the complementary sheets. At step 305, one or the sheets can be folded to define the mixing chamber partition walls. The condiments may then be deposited at step 306 and thereafter the perimeter of the complementary sheets and the partition walls can be bonded respectively to seal the compartments and mixing chamber. Bonding may be performed, for example, by heat staking, use of an adhesive, and the such.

Figure 5:
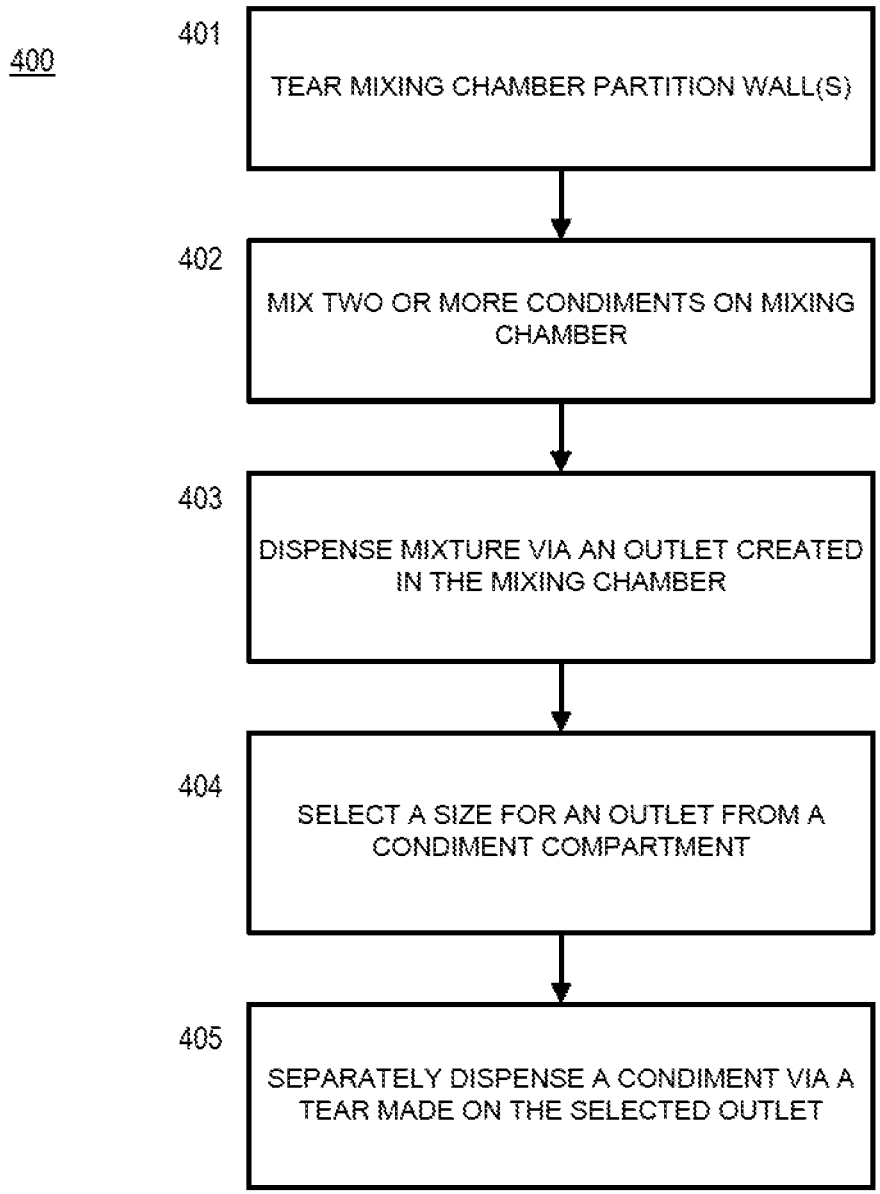
FIG. 5 is a flowchart 400 with method steps that may be implemented by a user of a configurable packet that functions according to some aspects of the disclosure.

Referring now to FIG. 5, a flowchart 400 with method steps that may be implemented by a user of a configurable packet that functions according to aspects of the disclosure is shown. In particular, steps to illustrate how aspects of the disclosed configurable packet can enable a use to mix and dispense condiments in a controlled and useful manner. At step 401, a user may breach one or more partitions of the mixing chamber. Breaching of the one or more walls may be facilitated by tabs, instructions that direct a user to pull or press on specific portions of the packet, for example. Once at least two of the partition walls of the mixing chamber are breached, condiments from the connecting compartments can be transferred to the mixing chamber. At step 402, the user can mix the different condiments by pressing on the walls of the mixing chamber or shaking action. Once mixed, at step 403, the user can create an outlet on the mixing chamber and dispense according to the properties of the outlet created, which as previously described, may be defined by the properties of the packet for the particular condiment(s)/mixture. Assuming the user may want to add more of one of the unmixed condiments contained/separate from the mixture, at step 404, the user may create an outlet on the corresponding condiment's compartment. The size of the outlet may be selected by the user depending on the embodiment and to allow, at step 405, more controlled dispensing of the additional condiment.

The many features and advantages of the invention are apparent from the detailed specification, and thus, it is intended by the appended claims to cover all such features and advantages of the invention which fall within the true spirit and scope of the invention. Further, because numerous modifications and variations will readily occur to those skilled in the art, it is not desired to limit the invention to the exact construction and operation illustrated and described, and accordingly, all suitable modifications and equivalents may be resorted to, falling within the scope of the invention.

I claim:

1. A packet for controllable mixing and dispensing of condiments, comprising:

at least a first compartment for containing a first condiment type and a second compartment for containing a second condiment type;

the first compartment formed by a pair of supple walls bonded to each other throughout the perimeter and to a first partition section, and having a dispensing end with at least one pre-perforated slit to provide an outlet for dispensing of said first condiment;

the first partition section being at least partially breachable to provide the first condiment type access to a mixing chamber;

the second compartment also formed by the pair of supple walls bonded to each other throughout the perimeter and to a second partition section;

the second partition being at least partially breachable to provide the second condiment type access to the mixing chamber; and the mixing chamber formed by at least the pair of supple walls bonded to each other throughout the perimeter of the package and defined by the first and second partitions, where in at least a portion of each of the first and second partitions is breachable by one or more pre-perforated slits made on the first and the second partitions, wherein plastic inserts are included in each of the pre-perforated slits of the first and second partitions, said plastic inserts are configured to prevent condiments in the mixing chamber from being transferred back to at least one of the first compartment or the second compartment, wherein the mixing chamber is configured to receive at least said first condiment and said second condiment upon the breaching of at least a portion of each of said first and second partitions without: unbending the supple walls from each other and releasing the condiments from the packet, and wherein the mixing chamber is additionally configured to dispense a mixture of at least said first and second condiments through a separate dispensing section having at least one pre-perforated slit.

2. The packet of claim 1, wherein the plastic insert is a valve additionally configured to control the flow of condiments and enable controlled mixing.

3. The packet of claim 1, wherein the pair of supple walls are assembled via heat staking.

4. The packet of claim 1, additionally comprising:

a folding slit on a portion of at least one of the supple walls configured to facilitate folding of the package for the dispensing of mixed condiments.

5. The packet of claim 4, wherein the folding slit includes at least a portion of the at least one pre-perforated slit of the separate dispensing section of the mixing chamber and having a pre-determined size to allow for controlled dispensing of the mixed condiments from the mixing chamber.

6. The packet of claim 1, wherein the second compartment additionally comprises:

a dispensing end having at least two pre-perforated slits of pre-determined sizes to allow for controlled dispensing of the second condiment.

7. A packet for controllable mixing and dispensing of toppings, the packet comprising:

at least a first compartment for containing a first condiment type and a second compartment for containing a second condiment type;

the first compartment formed by a pair of supple walls bonded to each other throughout the perimeter and to a first partition section;

the first partition section having a first plastic insert including one or more pre-perforated slits to enable the first partition section to be at least partially breachable as to provide the first condiment type one-way controlled access into a mixing chamber;

the second compartment also formed by the pair of supple walls to each other throughout the perimeter and to a second partition section;

the second partition section having a second plastic insert including one or more pre-perforated slits to enable the second partition section to be at least partially breachable as to provide the second condiment type one-way controlled access into the mixing chamber; and the mixing chamber formed by at least the pair of supple walls bonded to each other throughout the perimeter of the package and defined by the first and second partitions, wherein the mixing chamber is configured to receive at least said first condiment and said second condiment upon the breaching of at least a portion of each of said first and second partitions without unbonding the supple walls from each other and releasing the condiments from the packet.

8. The packet of claim 7, wherein the pair of supple walls are assembled via heat staking.

9. The packet of claim 7, additionally comprising:

a folding slit on a portion of one or the supple walls configured to facilitate folding of the package for dispensing of the mixed condiments on the mixing chamber.

10. The packet of claim 9, wherein the folding slit includes at least a portion of one or more pre-perforated slits having a pre-determined size to allow for controlled dispensing of the mixed condiments from the mixing chamber.

11. The packet of claim 7, additionally comprising:

a dispensing end of one or both of the first and second compartments having at least two pre-perforated slits of pre-determined sizes to allow for controlled dispensing of the second condiment.

12. The packet of claim 11, additionally comprising:

reinforcement strips around one or more of the at least two some of the pre-perforated slits having predetermined sizes used to control the breaching or tearing by a user.

* * * * *